United States Patent [19]

Williams, Jr.

[11] Patent Number: 4,872,834

[45] Date of Patent: Oct. 10, 1989

[54] RECOVERY BOILER PORT CLEANER

[76] Inventor: John W. Williams, Jr., 5501 Outley Dr., Mobile, Ala. 36693

[21] Appl. No.: 268,775

[22] Filed: Nov. 9, 1988

[51] Int. Cl.[4] ..... F27D 23/00

[52] U.S. Cl. ..... 432/75; 432/2; 15/104.1 C

[58] Field of Search ..... 432/2, 75; 15/104.1 C, 15/104.07

[56] References Cited

U.S. PATENT DOCUMENTS

| | | | |
|---|---|---|---|
| 3,918,375 | 11/1975 | Hayakawa et al. | 432/75 |
| 3,990,836 | 11/1976 | Bricmont | 432/75 |
| 3,990,949 | 11/1976 | Ovsyannikov | 432/75 |
| 4,102,001 | 7/1978 | Baba et al. | 15/104.1 C |
| 4,790,750 | 12/1988 | Bourel | 432/2 |

*Primary Examiner*—Henry C. Yuen

*Attorney, Agent, or Firm*—Birch, Stewart, Kolasch & Birch

[57] ABSTRACT

A recovery boiler port cleaner for a chemical recovery furnace, such as a sulfur-reducing recovery boiler, used in pulp and paper processing. The port cleaner is mounted on an exterior wall of the boiler and is comprised of a stainless steel port cleaning blade attached to a push rod which is slidable in a protective stainless steel sleeve extending into the boiler to a point adjacent a respective air port. A pneumatic cylinder for actuating the push rod is located on a stand-off support structure attached to a flat plate included on a mounting bracket welded to the boiler wall. The support structure acts to protect the air cylinder from the heat of the boiler and reduces the failure rate thereof. Also, a cover is provided on the outside of the stand-off support structure to protect personnel from movement of the push rod when activated. A solenoid valve for energizing the air cylinder is located remotely from the boiler and the mechanical assembly attached to the boiler wall.

17 Claims, 2 Drawing Sheets

RECOVERY BOILER PORT CLEANER

BACKGROUND OF THE INVENTION

1. Field of the Invention

This invention relates generally to apparatus for cleaning an air opening in a furnace and more particularly to apparatus for cleaning air ports in a chemical recovery boiler.

2. Description of the Prior Art

Sulfur-reducing recovery boilers used in pulp and paper processing are generally known and include a plurality of air ports located around the base of a huge boiler. As a part of the process, a build up of slag in the ports occurs which reduces oxygen flow to the burner flame thereby impairing the efficiency of the whole pulp and paper making process. Heretofore, ports in sulfur reducing recovery boilers which numbered anywhere from 50 to 200 ports, had to be cleaned manually as slag accumulated in the ports at the base of the boiler. Within the last several years, however, there has appeared several automatic port cleaning systems which eliminate the need for and the inefficiency associated with the manual cleaning of such boilers.

These automatic systems conventionally include one or more elongated cleaning rods which are mounted on the outside wall of the boiler and which are periodically actuated to enter the air ports and free the ports of debris by a reciprocating and/or oscillatory motion followed by retraction to some selected distance behind the air port so as not to obstruct the air flow into the boiler via the respective ports. Due to the manner in which the known prior art port cleaners have been constructed, parts having critical temperatures have been located much too close to the ports causing the parts to constantly break down, thereby increasing the down time and thus decreasing the efficiency of the sulfur-reducing recovery boiler.

Accordingly, it is an object of the present invention to provide an improvement in mechanical port cleaners.

It is another object of the invention to provide an automatic port cleaning system for sulfur reducing recovery boilers.

It is yet another object of the invention to provide an improved air port cleaner for sulfur-reducing recovery boilers which eliminates the manual cleaning process of the slag build up on recovery boiler air ports.

It is still another object of the invention to provide a recovery boiler port cleaner which provides substantially uniform air supply to increase boiler efficiency and to reduce boiler blackouts.

It is a further object of the invention to provide an improvement in mechanical port cleaners for sulfur-reducing recovery boilers which provide a safe environment for personnel operating around the recovery boiler.

SUMMARY

The foregoing and other objects are achieved by a recovery boiler port cleaner for a chemical recovery furnace, such as a sulfur-reducing recovery boiler, used in pulp and paper processing. The port cleaner is mounted on an exterior wall of the boiler and is comprised of a stainless steel port cleaning blade attached to a stainless steel push rod which is slidable in a protective stainless steel sleeve extending into the boiler to a point adjacent a respective air port. Metal bushings comprised of material which has a melting point greater than the furnace temperature is used in the push rod sleeve. A pneumatic cylinder for actuating the push rod is mounted on an elongated support structure attached to a mounting plate secured to the boiler wall. The support structure acts to protect the air cylinder from the heat of the boiler and reduces the failure rate thereof. Also, a cover is provided on the outside of the support assembly to protect personnel from movement of the push rod when activated. A solenoid valve for energizing the air cylinder is located remotely from the boiler and the mechanical assembly attached to the boiler wall. Thus there are no exposed moving parts so that plant personnel working around the boiler do not have to worry about exposed moving parts which could inadvertently cause injury.

BRIEF DESCRIPTION OF THE DRAWINGS

The invention will be best understood with reference to the following detailed description taken in conjunction with the accompanying drawings in which.

DESCRIPTION OF THE PREFERRED EMBODIMENT

Figure 1:
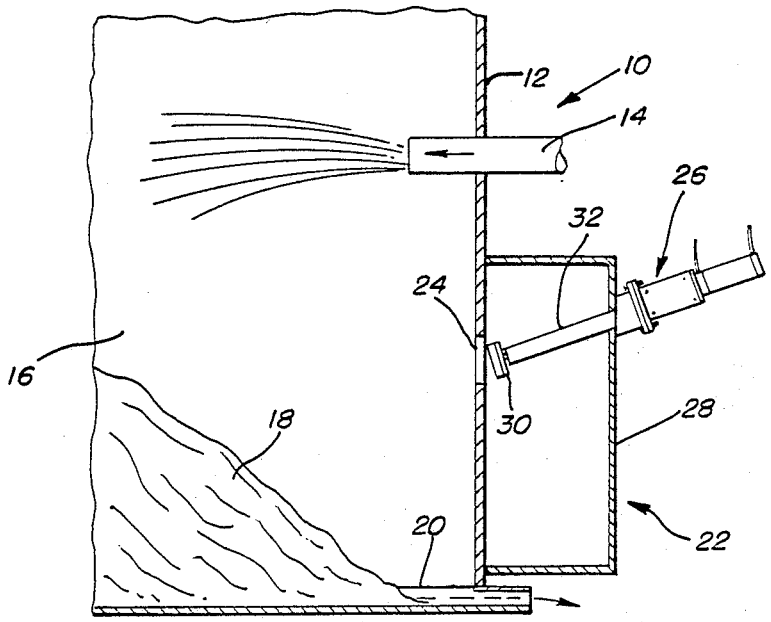
FIG. 1 is a simplified mechanical diagram broadly illustrative of the subject invention.

Referring now to the drawings wherein like reference numerals refer to like parts throughout, FIG. 1 is intended to broadly illustrate the invention as it relates to a sulfur-reducing recovery boiler for pulp and paper processing. As shown, reference numeral 10 denotes a chemical recovery furnace in the form of a recovery boiler. The boiler 10 includes an exterior wall member 12 which includes a delivery tube 14 for spraying a "black liquor" into a fire box 16 with the chemicals being deposited on the floor of the fire box as a char bed 18 from which a molten chemical containing smelt 20 is recovered for further processing at a location, not shown. A wind box 22 forms part of the boiler and surrounds the region of the fire box 16 to deliver combustion air under pressure into the fire box through a plurality of openings or air ports 24.

Further as shown in FIG. 1, the present invention is directed to air port cleaning apparatus 26 which is mounted on the exterior wall 28 for automatically cleaning the respective air port 24 of any debris such as sludge or slag which builds up so that a constant, stable flow of oxygen is fed into the fire box 16.

Figure 3:
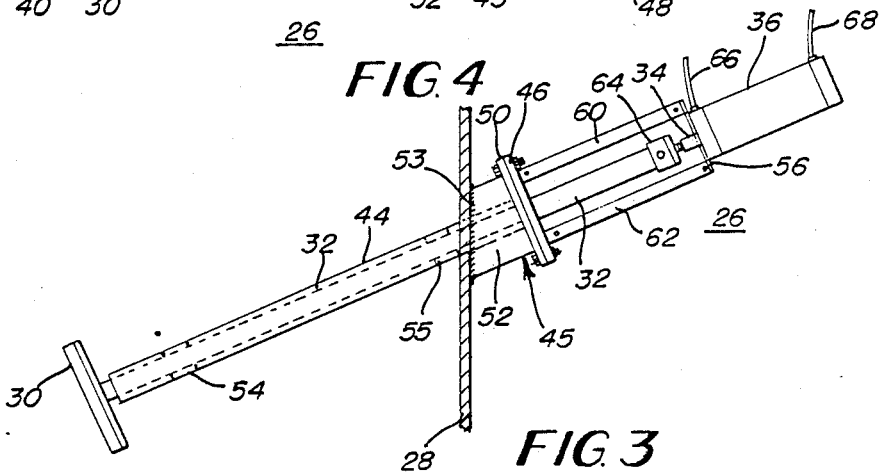
FIG. 3 is a side elevational view illustrating the details of the preferred embodiment of the invention shown in FIG. 2.

Considering now the details of the port cleaner apparatus 26, reference will first be made to FIG. 2. The port cleaner 26 illustrated thereat comprises a mechanical assembly for automatically reciprocating a stainless steel blade member 30 to and from the air port 24. The blade member 30 is orthogonally attached to one end of an elongated stainless steel push rod 32 whose other end, as further shown in FIG. 3, is mechanically attached to the plunger 34 of an air cylinder 36. The blade 30 is comprised of an elongated bar having a base portion 38 and two side surface portions 40 and 41 (FIG. 4) which converge along a forward edge 42. The edge 42 acts as the tip of the blade. The forward portion of the push rod 32 is slidably reciprocated within an elongated stainless steel protective sleeve 44 which passes through a mounting bracket 45 and is secured to the forward plate 46 of a stand-off subassembly 48. The mounting bracket 45 is comprised of a flat mounting plate 50 and a short length of rectangular tubing 52 which includes an inclined edge 53 which is adapted to be welded to the outer surface of the wall member 28.

The protective sleeve 44 is welded to the forward plate 46 of the stand-off subassembly 48 so that the whole unit can be removed through an enlarged rectangular opening 51 (FIG. 5) in the mounting plate 50 by removal of bolts, not shown, through holes 47 and thus leaving the mounting bracket 45 welded to exterior wall 28. The sleeve 44, moreover extends inwardly to a distance adjacent the end of the push rod 32 when retracted as shown in FIG. 2.

Figure 4:
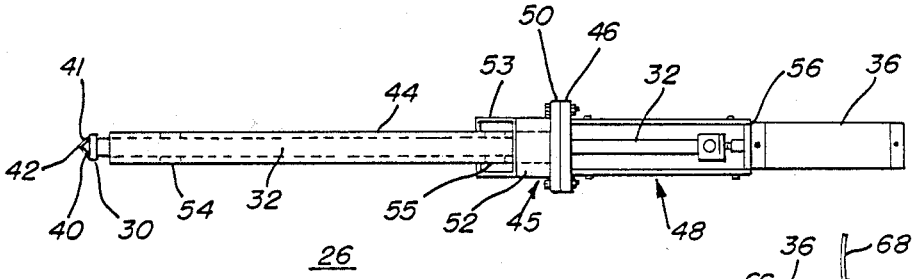
FIG. 4 is a top elevational view further illustrative of the details of the preferred embodiment of the subject invention.

As shown in FIGS. 3 and 4, the push rod 32 slides on a pair of metal bushings 54 and 55 located near the ends of the sleeve member 44. The bushings 54 and 55 are comprised of metallic elements configured, for example, from bronze which is capable of withstanding the extremely hot temperatures of the wind box 22 and eliminates the possibility of jamming, which could occur if a material such as synthetic materials having a melting point below the working environment of the port cleaner was utilized.

The air cylinder 36 is mounted on a rear plate 56 of the standoff subassembly 48. At least two elongated channel members 60 and 62 are located between the plates 46 and 56 and have a length at least equal to the forward movement of the push rod 32 when transporting the blade member 30 to and from the air port 24 when it is reciprocated by operation of the air cylinder 36. A metal cover 58 is secured to the channel members 60 and 62 for enclosing the standoff subassembly 48 and the upper section of the push rod 62 and its connecting member 64 as shown in FIG. 3 and thus protect operating personnel from the moving parts when the port cleaner is being actuated. Thus positioned, all the moving parts are enclosed for protection of the personnel working around the recovery boiler. By mounting the air cylinder 36 on the plate 56 behind the mounting bracket assembly bonded to the wall 28, it is also protected from the heat of the boiler and reduces its chance of failure.

Figures 2, 5:
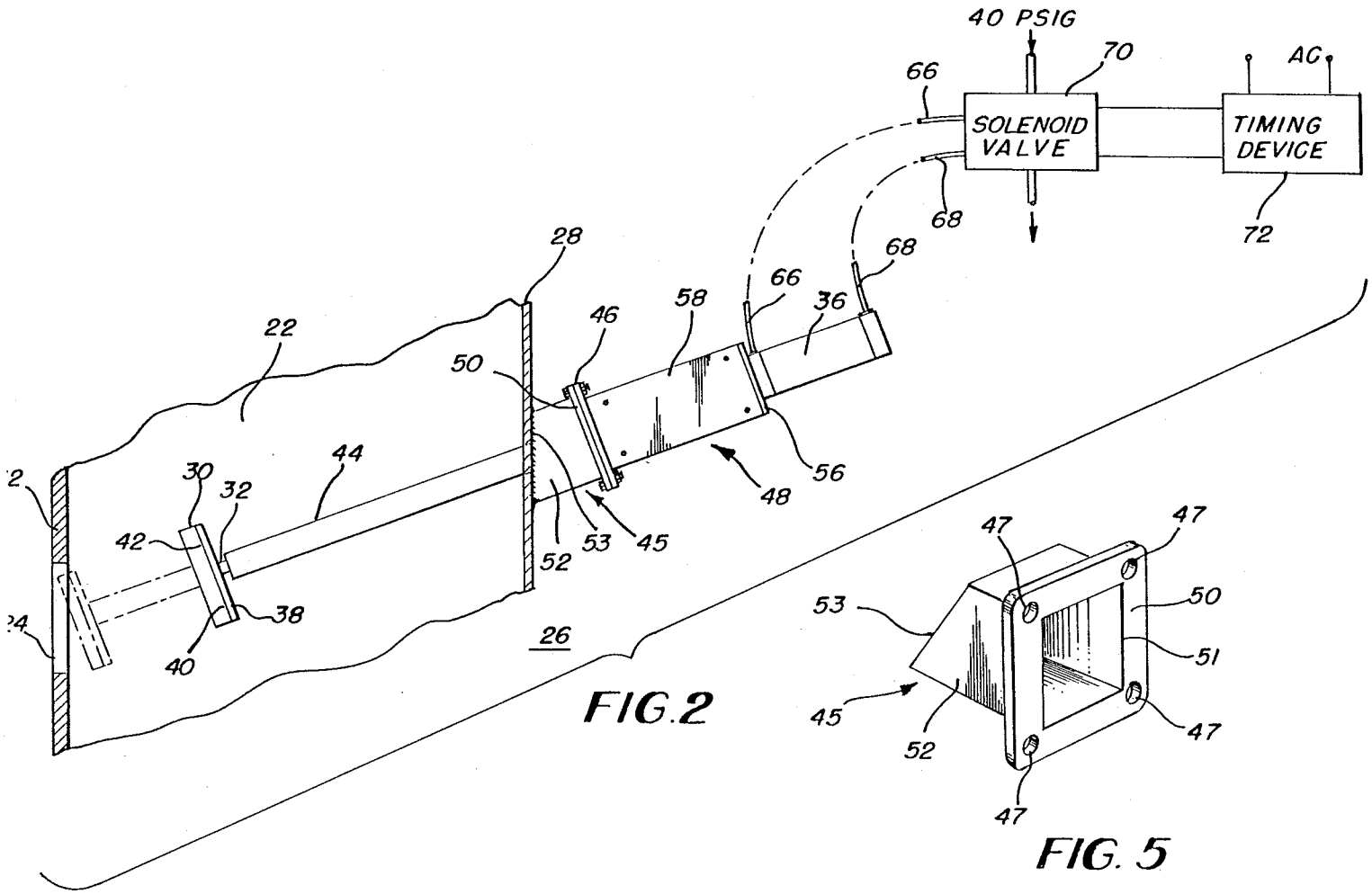
FIG. 2 is a side elevational view illustrating the preferred embodiment of the invention in position on a chemical recovery boiler.
FIG. 5 is a perspective view generally illustrative of a boiler wall mounting bracket for the embodiment of the subject invention as shown in FIG. 2.

The air cylinder 36 has a pair of air lines 66 and 68 attached to either end thereof for actuation of an internal piston, not shown, which operates to reciprocate the push rod 32 between an extended and retracted position as shown in FIG. 2. The air lines 66 and 68 in the present invention are coupled to a solenoid valve 70 which is located remotely from the air cylinder 36 and the port cleaning apparatus as shown in order to remove the valve from a relatively high temperature operating environment, thus lengthening its useful life. The solenoid valve is coupled to a source of compressed air, not shown, and is operated by an electrical timing device 72 which can be selectively set for actuating the solenoid valve 70, for example, every ten minutes, and thus initiate a port cleaning operation by the push rod 32 and blade 30.

By mounting the air cylinder 36 directly in line with the push rod 32 the apparatus required eliminates the need for extraneous moving parts, clutches and other mechanical components which are subject to breakage and thereby result in unnecessary down time. The alignment of the push rod with the air port 24 is furthermore achieved by four slotted mounting holes 47 being located in the mounting plate 50, as shown in FIG. 5. Thus when the push rod 32 is actuated by the air cylinder 36 under control of the solenoid valve 70, the blade member 30 is forced through the air port 24 to clean any deposit build up around the opening. The blade then retracts to its rest position as shown in FIG. 2 until the next cycle is initiated ten minutes later, for example.

While each port cleaning assembly 26 operates to clean one air port per unit, it should be noted that when desirable several can be ganged together in groups of three to six in their frequency of operation, but each unit is still mechanically independent from the other so that if one unit fails, only one air port will be affected and will therefore not effect boiler operation to any substantial amount. Typically, each port cleaning assembly is relatively light in weight, for example, approximately 40 pounds, so that one person can easily handle the unit which can be removed and a spare unit installed in the matter of a few minutes. The timing device 72 as well as the solenoid valve 70 operate with a conventional 120 volt AC line voltage, and a remote air supply supplying, for example 40 psig. of air is coupled to the cylinder 36 via the solenoid valve.

Thus what has been shown and described is a simple yet compact recovery boiler port cleaner unit having no external moving parts and which can withstand the harsh environment of recovery boilers and which is designed to assure maximum reliability while permitting quick and easy replacement.

Having thus shown and described what is at present considered to be the preferred embodiment of the invention, it should be known that the same has been made by way of illustration and not limitation and accordingly, all modifications, alterations and changes coming within the spirit and scope of the invention are herein meant to be included.

I claim:

1. Apparatus for cleaning an air opening in a furnace, comprising:

an elongated push rod;

an actuator coupled to said push rod for providing a reciprocatory linear motion of the push rod to and from said air opening;

a cleaning blade orthogonally attached to one end of said push rod and being operable to clean debris from the edges of said air opening when said push rod is actuated by said actuator to translate said blade to said air opening;

means for mounting said apparatus on a wall of said furnace;

means for attaching said actuator in stand off relationship with said mounting means to position said actuator a predetermined distance away from the wall of said furnace to provide heat protection for said actuator from the extreme heat radiated from the furnace; and an elongated protective sleeve for said push rod extending from said attaching means to a position adjacent said cleaning blade when said blade is positioned away from said air opening.

2. The apparatus as defined by claim 1 wherein said cleaning blade includes a pair of mutually angulated cleaning surfaces terminating in an elongated forward edge directed toward said air opening.

3. The apparatus as defined by claim 1 wherein said protective sleeve comprises a metal sleeve attached to said attaching means.

4. The apparatus as defined by claim 1 and additionally including at least one metal bushing for said push rod located inside of said sleeve.

5. The apparatus as defined by claim 1 and additionally including a pair of metal bushings in slidable engagement with said push rod located inside said sleeve.

6. The apparatus as defined by claim 5 wherein said metal bushings are located mutually apart from one another adjacent opposite ends of said sleeve.

7. The apparatus as defined by claim 6 wherein said bushings are comprised of bronze and said sleeve is comprised of stainless steel.

8. The apparatus as defined by claim 7 wherein said push rod and said cleaning blade are also comprised of stainless steel.

9. The apparatus as defined by claim 1 wherein said mounting means comprises a bracket including a mounting plate and a tubular member attached to said mounting plate, said tubular member having an inclined outer edge relative to said mounting plate, said edge being bonded to said furnace wall whereby said apparatus is inclined toward said air opening.

10. The apparatus as defined by claim 9 and wherein said means for attaching said actuator comprises a stand off assembly aligned with and permitting passage of said push rod therethrough for coupling to said actuator.

11. The apparatus as defined by claim 10 wherein said stand off assembly additionally includes a first plate member attachable to said mounting plate of said mounting means, a pair of generally parallel channel members having one end attached to and extending outwardly from said first plate member and a second plate member attached to the other end of said channel members for the mounting of said actuator thereon.

12. The apparatus as defined by claim 10 and additionally including side covering means around said stand off assembly for shielding the surrounding area from said push rod when actuated.

13. The apparatus as defined by claim 1 wherein said actuator comprises a pneumatic actuator.

14. The apparatus as defined by claim 13 and including a remotely located solenoid actuated valve coupled to said pneumatic actuator for powering said actuator from a source of compressed air.

15. The apparatus as defined by claim 14 and additionally including timing means for controlling said solenoid actuated valve to periodically energize said actuator and thereby translate said cleaning blade to said air opening.

16. The apparatus as defined by claim 1 wherein said furnace comprises a chemical recovery boiler.

17. The apparatus as defined by claim 1 wherein said air opening comprises an air port in a recovery boiler.

* * * * *

US004872834B1

REEXAMINATION CERTIFICATE (1714th)

United States Patent [19]

Williams, Jr.

[11] B1 4,872,834

[45] Certificate Issued Jun. 2, 1992

[54] RECOVERY BOILER PORT CLEANER

[76] Inventor: John W. Williams, Jr., 5501 Outley Dr., Mobile, Ala. 36693

Reexamination Request:
No. 90/002,338, May 3, 1991

Reexamination Certificate for:

| | |
|---|---|
| Patent No.: | 4,872,834 |
| Issued: | Oct. 10, 1989 |
| Appl. No.: | 268,775 |
| Filed: | Nov. 9, 1988 |

[51] Int. Cl.[5] ..... F27D 23/00

[52] U.S. Cl. ..... 432/75; 432/2; 110/182.5; 15/104.1 C

[58] Field of Search ..... 432/75, 2; 110/182.5

[56] References Cited

U.S. PATENT DOCUMENTS

| | | | |
|---|---|---|---|
| 570,129 | 10/1896 | Hartman . | |
| 2,922,175 | 1/1960 | De Villiers et al. | 266/269 |
| 3,742,916 | 7/1973 | Wessberg et al. | 122/390 |
| 3,875,904 | 4/1975 | Astrom | 122/235 B |
| 3,943,861 | 3/1976 | Astrom et al. | 122/6.6 |
| 4,027,604 | 6/1977 | Jansson | 122/6.5 |
| 4,099,471 | 7/1978 | Sander et al. | 122/6.6 |
| 4,114,865 | 9/1978 | McKarrow | 266/269 |
| 4,353,530 | 10/1982 | Iyama et al. | 266/45 |
| 4,423,533 | 1/1984 | Goodspeed | 266/269 |
| 4,653,409 | 3/1987 | Eriksson | 122/6.6 |
| 4,706,324 | 11/1987 | Goodspeed | 15/246 |
| 4,748,004 | 5/1988 | Goodspeed | 15/249 |
| 4,759,299 | 7/1988 | Kennedy et al. | 110/193 |

OTHER PUBLICATIONS

Latest addition to our family of products, The Rodding Robot automatically cleans recovery boiler air ports.

Rodding Robot Port Cleaner by Diamond Power Nov. 13, 1985.

An Installation of Rodding Robot Port Cleaners on a Recovery Boiler in Sweden.

And Now a Better Way to Keep Your Air Ports Clean by Babcock & Wilcox Company, Mar. 1987.

Diamond Power Specialty Company for Today and Tomorrow by Babcock & Wilcox Company, Mar. 1987.

*Primary Examiner*—Henry C. Yuen

[57] ABSTRACT

A recovery boiler port cleaner for a chemical recovery furnace, such as a sulfur-reducing recovery boiler, used in pulp and paper processing. The port cleaner is mounted on an exterior wall of the boiler and is comprised of a stainless steel port cleaning blade attached to a push rod which is slidable in a protective stainless steel sleeve extending into the boiler to a point adjacent a respective air port. A pneumatic cylinder for actuating the push rod is located on a stand-off support structure attached to a flat plate included on a mounting bracket welded to the boiler wall. The support structure acts to protect the air cylinder from the heat of the boiler and reduces the failure rate thereof. Also, a cover is provided on the outside of the stand-off support structure to protect personnel from movement of the push rod when activated. A solenoid valve for energizing the air cylinder is located remotely from the boiler and the mechanical assembly attached to the boiler wall.

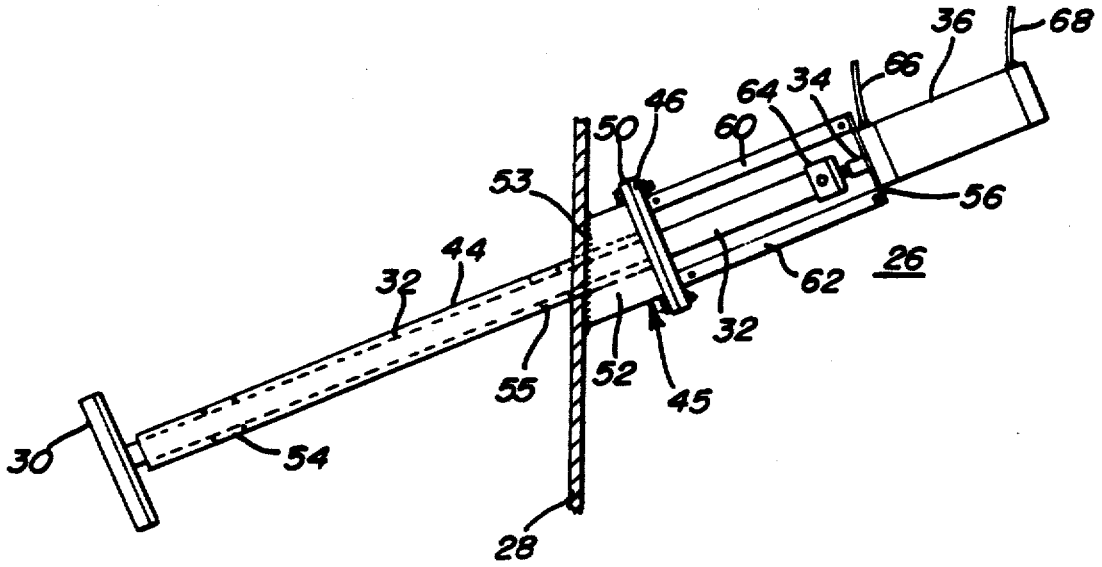

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 10, 16 and 17 are cancelled.

Claims 1, 3–5, 9, 11 and 12 are determined to be patentable as amended.

Claims 6, 7, 8, 13–15, dependent on an amended claim, are determined to be patentable.

New claim 18 is added and determined to be patentable.

1. Apparatus *secured to a wall of a wind box of a chemical recovery boiler type furnace* for *deslagging and* cleaning an air [opening] *intake port* in a *fire box wall of the* furnace, *and having no externally exposed moving parts when installed on the wind box,* comprising:

an elongated push rod;

an *in-line* actuator *directly* coupled to *one end of* said push rod for providing a reciprocatory linear motion of the push rod to and from said air [opening] *intake port;* a cleaning blade orthogonally attached [to one end of said push rod] *to the other end of the push rod* and being operable to *deslag and* clean debris from the edges of said air [opening] *intake port* when said push rod is actuated by said actuator to translate said blade to said [air opening] *intake port;*

*closed side surface mounting* means for [mounting said apparatus on a] *attachment to an outer* wall of said [furnace] *wind box and comprising a mounting bracket assembly including a rear mounting plate and a length of tubing attached to said rear mounting plate, said length of tubing being attachable to said outer wall of said wind box;*

[means] *a closed side surface stand-off assembly* for attaching said actuator *to said mounting means* in [stand off] *stand-off* relationship [with said mounting means to position] *therewith for positioning* said actuator a predetermined *safe operating* distance away from [the] *said outer* wall of said [furnace] *wind box* to provide heat protection for said actuator from the extreme heat radiated from the furnace, *said stand-off assembly further including a front mounting plate for attachment to said rear mounting plate of said mounting means*

*said closed side surface mounting means and said closed side surface stand-off assembly further providing protection from any moving parts outside of said wind box*; and

[an] *a stationary* elongated [protective] *continuous tubular* sleeve *extending into the wind box* for *protecting* said push rod [extending from said attaching means to a position adjacent said cleaning blade] *and including heat resistant bushing means therein located forward of said front mounting plate of said stand-off assembly, said sleeve being cantilevered and attached to and extending forward from said front mounting plate of said stand-off assembly to a position in relatively close proximity to said forward end of the push rod and a rear end portion of the cleaning blade* when said *cleaning* blade is positioned away from said air opening[.] *so that substantially the entire forward portion of the push rod projecting into the wind box is protected, when deactivated, from heat and debris tending to bind the push rod when periodically actuated,*

*said protective sleeve, push rod, cleaning blade, stand-off assembly and actuator providing a relatively simple, safe and reliable enclosed unitary structure which can easily be installed and removed as a single unit from said mounting bracket assembly.*

3. The apparatus as defined by claim 1 wherein said protective sleeve comprises a metal sleeve [attached to said attaching means].

4. The apparatus as defined by claim 1 [and additionally including] *wherein said bushing means comprises* at least one metal bushing for said push rod located inside of said sleeve.

5. The apparatus as defined by claim 1 [and additionally including] *wherein said bushing means comprises* a pair of metal bushings in slidable engagement with said push rod located inside said sleeve.

9. The apparatus as defined by claim 1 wherein [said mounting means comprises a bracket including a mounting plate and a tubular member attached to said mounting plate, said tubular member having] *said outer shell of said mounting means includes* an inclined [outer] *forward* edge relative to said *rear* mounting plate, said *forward* edge being bonded to said [furnace] *wind box* wall whereby said apparatus is inclined toward said air [opening] *intake port.*

11. The apparatus as defined by claim [10] *1* wherein said [stand off] *stand-off* assembly additionally includes [a first plate member attachable to said mounting plate of said mounting means,] a pair of generally parallel channel members having one end attached to and extending outwardly from said [first plate member] *front mounting plate* and a second *mounting* plate [member] attached to the other end of said channel members for the mounting of said actuator thereon.

12. The apparatus as defined by claim [10] *11* and additionally including side covering means [around said stand off assembly] *attached to said channel members* for shielding the surrounding area *and protecting operating personnel* from said push rod when actuated.

*18. The apparatus as defined by claim 1 wherein said cleaning blade comprises a substantially straight generally upright bar member aligned in a vertical plane and including a solid body portion having two mutually angulated flat forward side surfaces co-extensive with the length of said body portion and converging inwardly along a single centralized upright forward linear leading edge running the length of said body portion and being operable to clean debris from the edges of said air opening when said push rod is actuated by said actuator to translate said blade to said air opening.*

* * * * *